US012773645B2

(12) United States Patent
Hunt

(10) Patent No.: US 12,773,645 B2
(45) Date of Patent: Oct. 27, 2026

(54) INTERACTIVE MOTORIZED ROTATING TOY

(71) Applicant: KIDS2, INC., Atlanta, GA (US)

(72) Inventor: James Hunt, Atlanta, GA (US)

(73) Assignee: KIDS2, LLC, Atlanta, GA (US)

( * ) Notice: Subject to any disclaimer, the term of this patent is extended or adjusted under 35 U.S.C. 154(b) by 267 days.

(21) Appl. No.: 18/527,246

(22) Filed: Dec. 2, 2023

(65) Prior Publication Data

US 2024/0181367 A1 Jun. 6, 2024

Related U.S. Application Data

(60) Provisional application No. 63/429,774, filed on Dec. 2, 2022.

(51) Int. Cl.
*A63H 33/00* (2006.01)
*A63H 33/26* (2006.01)

(52) U.S. Cl.
CPC ..... *A63H 33/005* (2013.01); *A63H 33/26* (2013.01)

(58) Field of Classification Search
CPC ..... A63H 33/005; A63H 33/26
See application file for complete search history.

(56) References Cited

U.S. PATENT DOCUMENTS 3,628,283 A 12/1971 Mizoule
4,867,726 A * 9/1989 Fujimaki ..... A63H 3/28 446/175
5,114,376 A * 5/1992 Copley ..... A63H 3/006 446/485
5,141,464 A * 8/1992 Stern ..... A63H 13/02 446/353
5,254,007 A * 10/1993 Eagan ..... A47D 1/0085 D6/406.3
5,267,886 A 12/1993 Wood et al.
5,334,076 A * 8/1994 Shinozuka ..... A63H 30/04 439/700
5,471,192 A * 11/1995 Dash ..... A63H 3/28 446/176
5,846,115 A * 12/1998 Feng ..... A63H 3/48 446/175
5,949,050 A 9/1999 Fosbenner et al.
6,027,395 A * 2/2000 Strom ..... A63H 11/10 446/457
6,053,797 A * 4/2000 Tsang ..... A63H 3/28 446/297
6,123,600 A * 9/2000 Yuen ..... A63H 11/205 446/280
6,149,490 A * 11/2000 Hampton ..... A63H 3/48 446/298

(Continued)

*Primary Examiner* — Michael D Dennis
*Assistant Examiner* — Matthew B Stanczak
(74) *Attorney, Agent, or Firm* — Perilla Knox & Hildebrandt LLP; Stephanie L. Davy-Jow

(57) ABSTRACT

A motorized children's toy with capacitive touch interactivity. The children's toy includes a toy body with motorized wheels and a plurality of user input areas with capacitive touch sensors. The motorized wheels are configured to operate in response to a sequence of user interaction with the user input areas and spin the toy body in according to the sequence of user interaction with the user input areas. The children's toy also includes light and/or sound emitting devices which activate in response to user interactions with the user input areas.

17 Claims, 5 Drawing Sheets

(56) References Cited

U.S. PATENT DOCUMENTS 6,227,933 B1* 5/2001 Michaud ..... A63H 33/005 446/458
6,231,346 B1* 5/2001 Sagi-Dolev ..... G09B 23/00 446/73
6,297,438 B1* 10/2001 Por Paul ..... G10H 1/32 84/743
6,354,842 B1* 3/2002 Frei ..... G09B 19/167 434/258
6,702,644 B1* 3/2004 Hornsby ..... A63H 3/008 446/268
6,807,291 B1* 10/2004 Tumey ..... A63H 3/28 434/155
6,881,122 B2 4/2005 Bloch et al.
6,905,390 B2* 6/2005 Fukui ..... B25J 19/00 446/337
6,947,714 B2 9/2005 Weiss et al.
7,033,241 B2 4/2006 Lee et al.
7,294,060 B2 11/2007 Ferrigno et al.
7,374,481 B2* 5/2008 Rehkemper ..... A63F 3/00643 446/175
7,607,734 B2 10/2009 Clapper et al.
7,662,017 B2 2/2010 Moll et al.
7,717,798 B2 5/2010 Bellows et al.
7,789,762 B2 9/2010 Greger et al.
7,824,273 B2 11/2010 Clapper et al.
7,883,426 B2 2/2011 Bellows et al.
7,884,710 B2 2/2011 Godiska et al.
8,098,240 B2 1/2012 Zielinski et al.
8,358,286 B2 1/2013 Cannon
8,371,897 B1* 2/2013 Wong ..... A63H 3/28 446/72
8,398,451 B2 3/2013 Wolfe et al.
8,471,138 B2 6/2013 Wallace et al.
8,562,387 B1* 10/2013 Henthorne ..... A63H 30/04 180/218
8,564,547 B2 10/2013 Amireh et al.
8,628,371 B2 1/2014 D'Alleva et al.
8,662,955 B1* 3/2014 Fai ..... A63H 13/005 446/337
8,729,379 B2 5/2014 Wallace et al.
8,773,387 B2 7/2014 Wallace et al.
9,092,096 B2 7/2015 Li et al.
9,259,658 B2 2/2016 Hillis et al.
9,944,268 B2 4/2018 Taylor et al.
10,188,957 B2 1/2019 Teel et al.
10,596,477 B1* 3/2020 Whipple, Jr. ..... A63H 17/00
10,804,898 B2 10/2020 Haslette et al.
10,870,064 B1* 12/2020 Standing ..... A63H 30/04
11,020,679 B1* 6/2021 Sledge ..... A63H 13/005
11,498,225 B2* 11/2022 Kim ..... B25J 13/081
11,648,485 B2* 5/2023 Blaustein ..... A63H 17/395 446/431
11,786,831 B2* 10/2023 Atsumi ..... A63H 3/003 446/353
11,833,975 B2 12/2023 Biesinger et al.
12,366,941 B2* 7/2025 Reese ..... G09B 5/06
2001/0031604 A1* 10/2001 Hornsby ..... A63H 33/00 901/1
2002/0016128 A1* 2/2002 Saito ..... A63H 3/28 446/268
2002/0049021 A1* 4/2002 Hornsby ..... A63H 11/10 446/289
2002/0081937 A1* 6/2002 Yamada ..... A63H 11/00 446/175
2002/0123297 A1* 9/2002 Hornsby ..... A63H 29/22 446/484
2003/0124953 A1* 7/2003 Hornsby ..... A63H 33/00 446/475
2003/0162475 A1* 8/2003 Pratte ..... A63H 3/28 446/175
2004/0043696 A1* 3/2004 Suzuki ..... A63H 3/28 446/268
2004/0119342 A1* 6/2004 Sato ..... G01D 5/2405 307/652
2004/0152394 A1* 8/2004 Marine ..... A63H 3/28 446/175
2004/0219499 A1* 11/2004 Cesa ..... A63H 11/00 434/258
2006/0003664 A1* 1/2006 Yeh ..... A63H 3/28 446/175
2006/0099882 A1* 5/2006 Eckerman ..... A63H 29/24 446/470
2006/0105671 A1* 5/2006 Connolly ..... A63H 3/006 446/485
2007/0012304 A1 1/2007 van Dorsser et al.
2007/0190511 A1 8/2007 Ernst et al.
2008/0014830 A1 1/2008 Sosnovskiy et al.
2008/0102729 A1* 5/2008 Ekstein-Lieberman ..... A63H 3/38 446/297
2008/0166945 A1* 7/2008 Cheng ..... A63H 11/20 446/268
2008/0166946 A1* 7/2008 Gallagher ..... A63H 17/395 446/436
2008/0268744 A1 10/2008 Jones
2009/0098793 A1* 4/2009 Wang ..... A63H 3/28 446/390
2009/0104844 A1* 4/2009 Chen ..... A63H 11/20 446/376
2009/0117525 A1* 5/2009 Bavaro ..... A63B 69/002 434/247
2009/0197504 A1* 8/2009 Hsu ..... A63H 3/28 446/330
2010/0062681 A1* 3/2010 Yang ..... A63H 11/10 446/465
2010/0075570 A1* 3/2010 Cameron ..... A63H 13/02 446/330
2011/0065354 A1* 3/2011 Wolfe ..... A63H 3/28 446/337
2011/0195392 A1 8/2011 Kim
2011/0269374 A1* 11/2011 Hornsby ..... A63H 17/36 446/484
2011/0281492 A1 11/2011 Chan
2011/0294397 A1* 12/2011 Tsai ..... A63H 33/005 446/454
2012/0050198 A1 3/2012 Cannon
2012/0073032 A1* 3/2012 Tigan ..... A42B 1/004 446/376
2012/0194457 A1 8/2012 Cannon et al.
2012/0252306 A1* 10/2012 Chan ..... A63H 3/20 446/90
2012/0302128 A1* 11/2012 McClintock ..... A63H 33/005 446/431
2012/0306802 A1* 12/2012 McCracken ..... G06F 3/04166 345/174
2013/0083946 A1* 4/2013 Liu ..... H03K 17/9622 381/109
2013/0090035 A1* 4/2013 Walker, Jr. ..... A63F 7/249 446/176
2013/0173089 A1* 7/2013 Bernstein ..... A63H 30/04 180/21
2014/0002362 A1* 1/2014 Srivastava ..... G06F 3/03549 345/167
2014/0038489 A1* 2/2014 Sharma ..... A63H 30/04 446/175
2014/0194030 A1 7/2014 Stucke, Jr. et al.
2014/0273728 A1* 9/2014 Rehkemper ..... A63H 11/10 446/465
2014/0282033 A1 9/2014 Cannon
2014/0315468 A1* 10/2014 Vasquez ..... A63H 13/02 446/354
2015/0024350 A1* 1/2015 Ward ..... A63F 3/00643 434/128
2015/0151196 A1* 6/2015 Bucci ..... A63H 33/005 901/1
2015/0286294 A1 10/2015 Küpcke et al.
2015/0375130 A1* 12/2015 Cannon ..... A63H 17/395 446/454

(56) References Cited

U.S. PATENT DOCUMENTS

| | | | | |
|---|---|---|---|---|
| 2016/0089613 | A1* | 3/2016 | Stubenfoll | A63H 31/00 446/239 |
| 2016/0151716 | A1* | 6/2016 | Nagai | A63H 29/22 446/237 |
| 2016/0354701 | A1 | 12/2016 | Breckman | |
| 2017/0105389 | A1* | 4/2017 | Sanchez | A01K 15/025 |
| 2017/0192517 | A1* | 7/2017 | Hygh | A63F 13/212 |
| 2017/0269589 | A1* | 9/2017 | Clarke | A63H 29/22 |
| 2018/0043838 | A1* | 2/2018 | Ellerman | A63H 33/005 |
| 2018/0043952 | A1* | 2/2018 | Ellerman | A63H 33/005 |
| 2018/0200613 | A1* | 7/2018 | Brattesani | A63H 1/02 |
| 2018/0236367 | A1* | 8/2018 | Bills | B60K 7/0007 |
| 2018/0311569 | A1* | 11/2018 | Bucci | G06N 3/008 |
| 2018/0326312 | A1* | 11/2018 | Sufer | A63H 3/001 |
| 2019/0009183 | A1* | 1/2019 | Bearsch | A63H 33/005 |
| 2019/0059611 | A1 | 2/2019 | Burns et al. | |
| 2019/0212728 | A1* | 7/2019 | Tahara | A63F 9/24 |
| 2020/0016476 | A1* | 1/2020 | Miller | A63D 15/003 |
| 2020/0050299 | A1* | 2/2020 | Lin | G06F 3/041 |
| 2020/0376398 | A1 | 12/2020 | Su | |
| 2021/0129010 | A1 | 5/2021 | Rubin | |
| 2022/0297023 | A1* | 9/2022 | Hauwaerts | A63H 3/006 |
| 2023/0117090 | A1 | 4/2023 | Mountz et al. | |
| 2024/0181367 | A1* | 6/2024 | Hunt | A63H 3/28 |

* cited by examiner

INTERACTIVE MOTORIZED ROTATING TOY

CROSS-REFERENCE TO RELATED APPLICATION

This application claims the benefit of U.S. Provisional Patent Application Ser. No. 63/429,774 filed Dec. 2, 2022, the entirety of which is hereby incorporated herein by reference for all purposes.

TECHNICAL FIELD

The present disclosure relates generally to the field of children's toys, and more particularly to an interactive rotating toy.

BACKGROUND

Interactive toys stimulate and entertain children and contribute to childhood development. Electronic capacitive touch sensing technologies provide means for user input to such interactive devices. It is to the provision of motorized children's toys and other interactive products having new and improved capacitive touch sensor-based user input means that the present disclosure is primarily directed.

SUMMARY

In example embodiments, the present disclosure provides an interactive children's toy having motorized components and capacitive touch capabilities. The children's toy generally comprises one or more motorized wheels configured to spin or move the children's toy in a predetermined direction depending on the sequence or order of user inputs. The children's toy may also produce sound and/or lighting effects in response to the user inputs.

In one aspect, the present disclosure relates to an interactive children's toy including a housing or shell, a plurality of user input areas or interfaces for receiving user inputs, and a motor operative in response to the user inputs.

Preferably, the user input interfaces may comprise one or more capacitive touch sensors.

Optionally, the interactive children's toy may also comprise light sources operative in response to the user inputs. Optionally, the interactive children's toy may also comprise an audio output device operative in response to the user inputs.

Optionally, the interactive children's toy may further comprise a processor configured to receive an input signal corresponding to the user inputs. Preferably, the motor is configured to receive an output signal from the processor and operate in response to the output signal.

Preferably, the user input interfaces are arranged circumferentially around the housing. Moreover, each user input interface is equidistant to its adjacent user input interfaces. Further, the motor is configured to operate at varying intensities based on the distance between successive user inputs.

Preferably, the motor is configured to spin the toy body in a first direction or in an opposite, second direction depending on the sequence of user inputs. In example embodiments, the interactive children's toy further comprises at least one wheel wherein the at least one wheel is operatively connected to the motor for driving the wheel. In some example embodiments, the user input interfaces are distributed around the housing and, when the user input interfaces are activated in a clockwise direction, the children's toy spins in the clockwise direction and, when the user input interfaces are activated in a counter-clockwise direction, the children's toy spins in the counter-clockwise direction.

In another aspect, the present disclosure relates to a motorized rotating toy. In example embodiments, the motorized rotating toy includes a toy body or base, a plurality of user input sensors arranged radially around the central base, one or more wheels attached to the central base, a processor configured to receive an input signal corresponding to a user interaction with at least one of the user input sensors, and at least one wheel, at least one light source, and at least one audio speaker configured to receive output signals from the processor and operate corresponding to the output signals.

In example embodiments, the motorized rotating toy comprises a plurality of wheels wherein at least one wheel is configured to rotate in a first rotational direction and at least one other wheel is configured to rotate in a second rotational direction opposite the first rotational direction so as to cause the interactive toy to spin in place. Preferably, the direction in which the interactive toy spins in place is controlled by the sequence in which the user input sensors are activated. Preferably, at least one of the user input sensors is a capacitive touch sensor. Preferably, the user input sensors are mapped to notes of a musical scale.

In yet another aspect, the present disclosure relates to an interactive children's entertainment device. In example embodiments, the entertainment device includes a central body, a plurality of interactive extending arms hingedly coupled to the central body, a top button, and at least one motorized wheel allowing the entertainment device to move and spin and/or rotate. The entertainment device is operable in at least four different modes of play of increasing complexity to accommodate development of a child user. The at least four different modes of play includes a tummy time mode, a sit-to-play mode, a chase mode, and a dance mode. In the tummy time mode, the entertainment device plays fun melodies and sounds with flashing lights in a stationary position providing interactive entertainment to the child user. In the sit-to-play mode, the entertainment device plays fun melodies and interactive learning content while rotating side-to-side and spinning in circles. In the chase mode, the entertainment device rotates and moves around a support surface or floor in multiple directions encouraging the child user to chase or run after the entertainment device. In the dance mode, the entertainment device plays fun sung melodies with learning content inspiring the child user to move and learn as the entertainment device executes complex motion profiles.

These and other aspects, features and advantages of the disclosed example embodiments will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
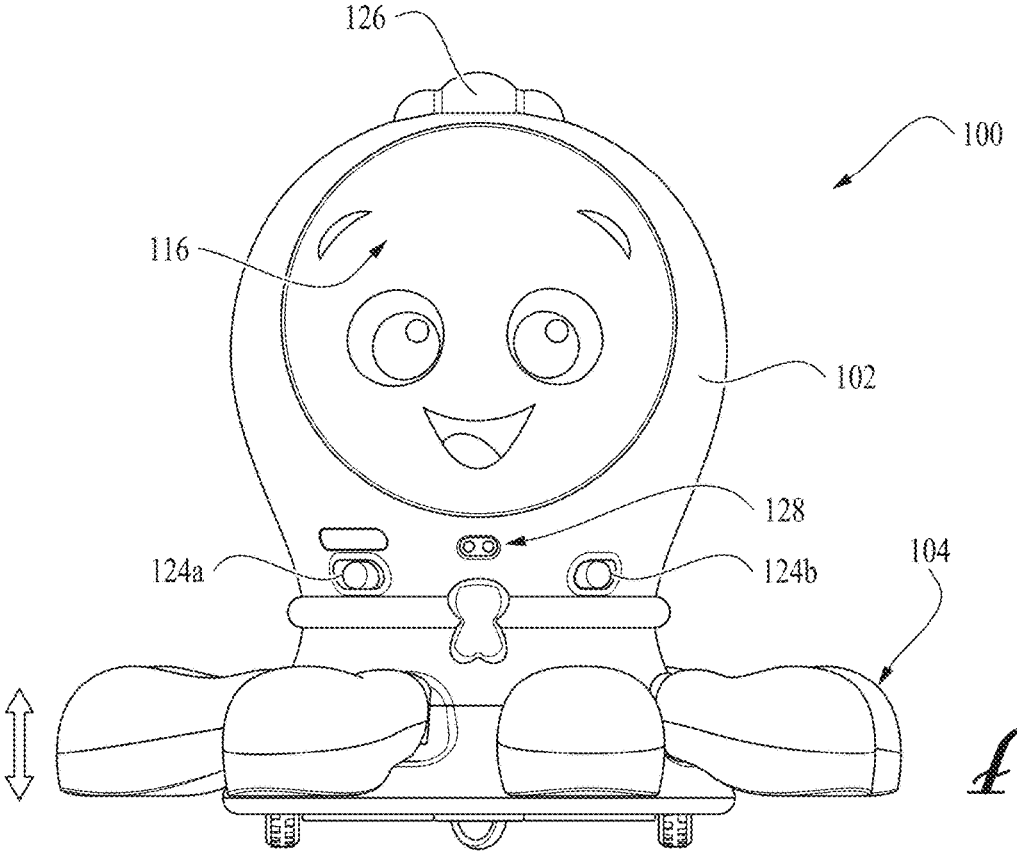
FIG. 1 is a front view of a motorized interactive children's toy according to an example embodiment of the present disclosure.
Figure 2:
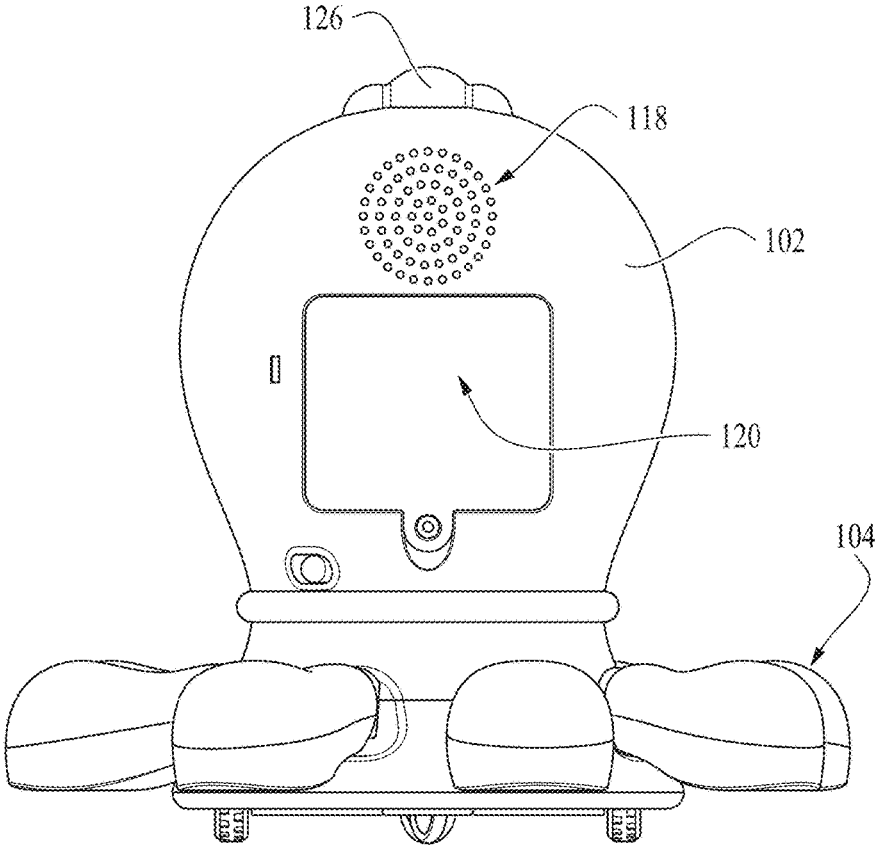
FIG. 2 is a rear view of the motorized interactive children's toy of FIG. 1.

With reference now to the drawing figures, wherein like reference numbers represent corresponding parts throughout the several views, FIGS. 1-6 show an interactive children's toy 100 according to an example embodiment of the present invention. As shown in FIGS. 1 and 2, the interactive toy 100 generally includes a toy body or housing 102, a plurality of interactive arms or tentacles 104 extending radially from the toy body 102, a drive system including a pair of motorized wheels 108*a* and 108*b*, and an input-output controller or integrated circuit (not shown). Optionally, the interactive toy 100 may further include one or more audio, visual, and/or haptic feedback or output devices, such as for example light emitting devices, speakers or audio output devices 118, or other user-perceptible output devices.

Figure 4:
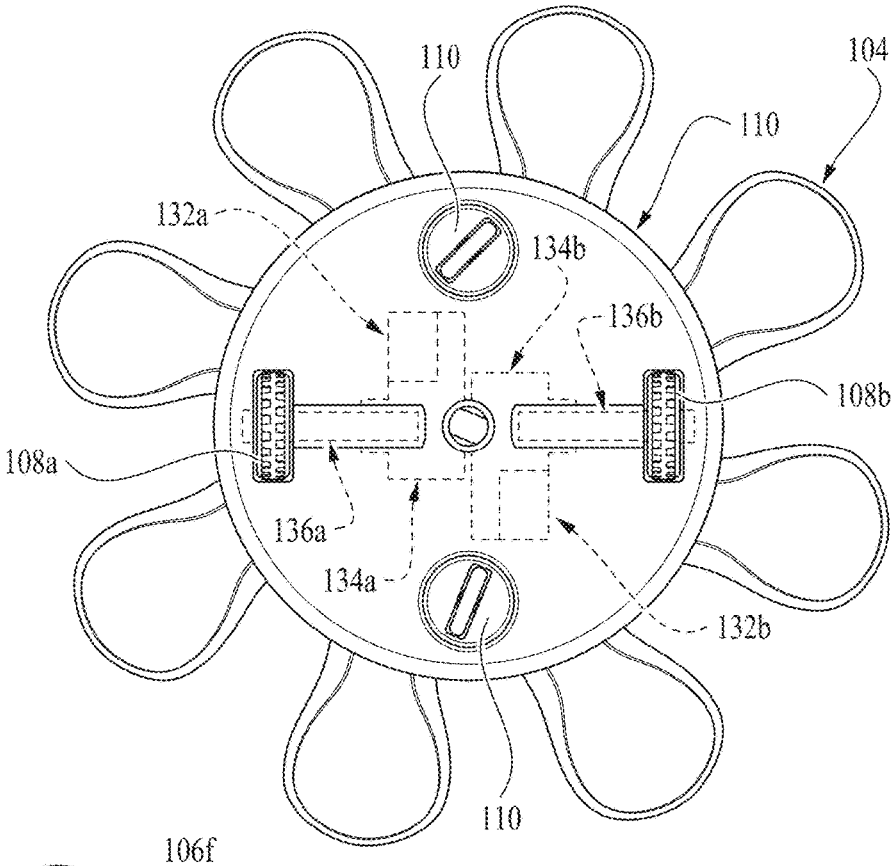
FIG. 4 is a bottom view of the interactive children's toy of FIG. 1.
Figure 3:
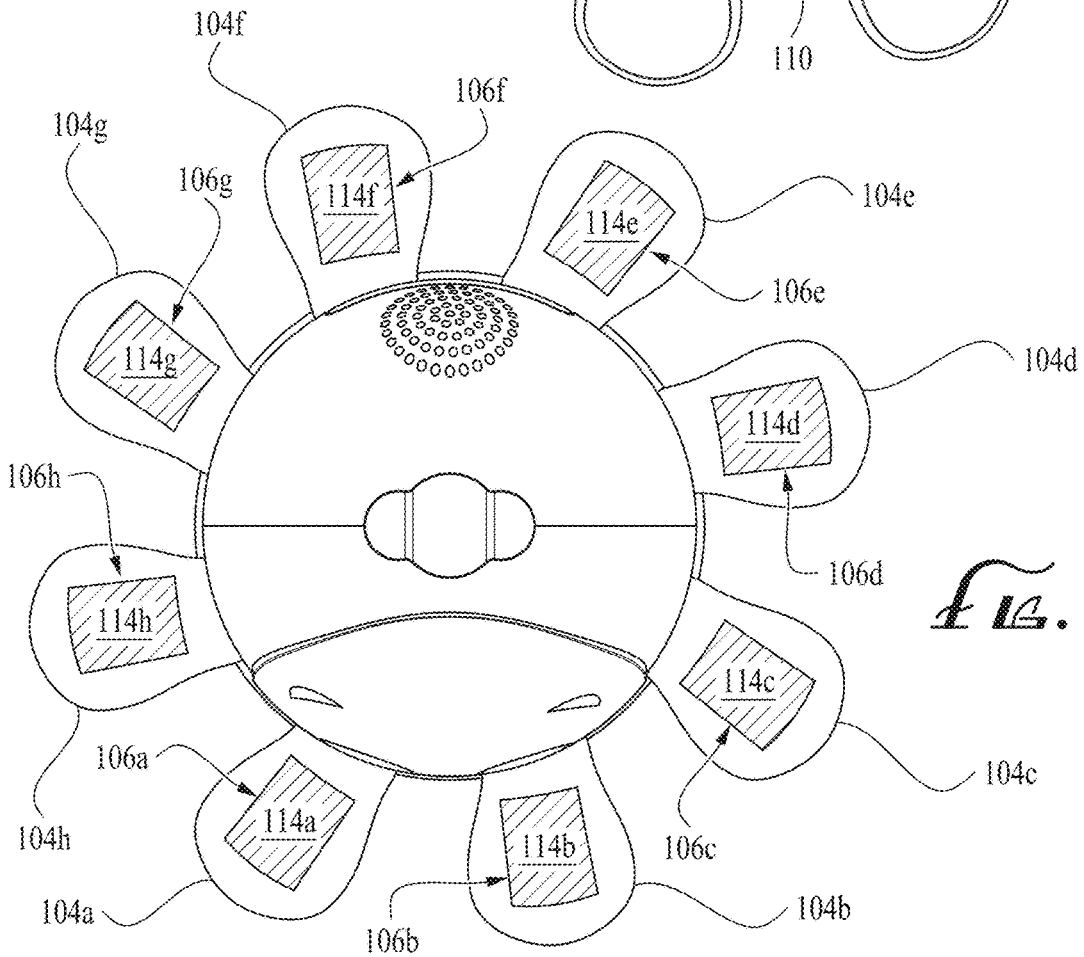
FIG. 3 is a top view of the interactive children's toy of FIG. 1.

In example embodiments, the toy body 102 comprises a central shell or base portion, for example having one or more shell portions configured for assembly together to define an internal housing chamber therein. Each of the plurality of interactive arms or tentacles 104 (i.e., 104*a*-*h*) includes a user input area 114 (i.e., 114*a*-*h*) comprising a capacitive discharge conductive material and a capacitive touch sensor 106 (i.e., 106*a*-*h*) affixed beneath each respective user input area. For example, the capacitive touch sensors 106 are in operative contact with for example an internal, underside, and/or hidden surface of the interactive arms 104, such as shown in FIG. 4. The capacitive touch sensors 106 comprise an electrically conductive material such as, for example a copper or other metallic foil, sheet, strip, panel, button, or other configuration, and are connected by wires or other electrical conductors to the electronic input-output control system or processor. In some embodiments, the capacitive touch sensors may be embedded in the capacitive discharge conductive material of the interactive arms 104. In preferred embodiments, interactive arms 104 comprise a relatively thin material thickness adjacent the user input areas 114 for improved capacitive touch sensitivity, and optionally further comprise a relatively thicker material thickness in one or more surrounding or peripheral areas outside of the user input areas for improved durability and structural strength.

According to example embodiments, the interactive arms 104 are activated by making contact with the user input areas 114 such that said contact is detected by the capacitive touch sensors 106. When a user contacts the user input areas 114, the capacitive touch sensors 106 detect the change in capacitance resulting from the user contact with the capacitive discharge conductive material and provide an electronic input signal to the input-output control system or integrated circuit indicating a user contact. The input-output control system or integrated circuit is preferably mounted inside or on the toy body 102. In example embodiments, the input-output control system is generally configured to receive the input signals generated by the capacitive touch sensors and to generate a responsive output signal. The children's toy preferably also includes one or more output devices configured to receive the output signal from the control system and generate user-perceptible outputs in response thereto. Optionally, the input-output control system may include one or more integrated circuits such as application specific integrated circuits incorporating onboard microprocessor(s), digital memory, and/or application software for carrying out capacitive user input touch sensing, interactive voice/melody output, light output, and/or other input/output features of the toy 100.

The drive system of the interactive toy 100 generally comprises one or more wheels 108 driven by one or more motors 132 configured to receive output signals from the input-output controllers and operate in response thereto. For example, the drive system may include a single motor configured to operate or move the interactive toy, or the drive system may include two or more cooperatively or independently operated motors. In some example embodiments, one or more motors may be configured to operate and/or move the interactive toy without wheels. Optionally, the interactive toy may also include other non-driven wheels or castors for balance and/or support. In the depicted embodiment, for example, the interactive toy 100 includes two motorized wheels 108*a* and 108*b* (as shown in FIG. 4) driven by motors 132*a* and 132*b*. The motorized wheels are operatively connected to the motors through axles 136*a* and 136*b* and gearboxes 134*a* and 134*b*. The interactive toy 100 further includes two non-driven castor wheels 110 providing balance and support to the two motorized wheels 108*a* and 108*b*. As shown in FIG. 4, the two motorized wheels 108*a* and 108*b* are preferably positioned diametrically across toy body 102. For example, the wheels 108*a* and 108*b* are preferably aligned along a diameter or a center line across the cross-sectional profile of the toy body 102. Preferably, the motorized wheels 108*a* and 108*b* and non-motorized castor wheels 110 only partially extend beyond the bottom cover 110 to minimize the gap between the bottom cover 110 and the floor or support surface during use in order to reduce the chances of other objects becoming lodged between the toy 100 and the floor and the toy 100 becoming stuck. In some example embodiments, there may be one or more than two motorized wheels and non-motorized castor wheels.

Figure 5A:
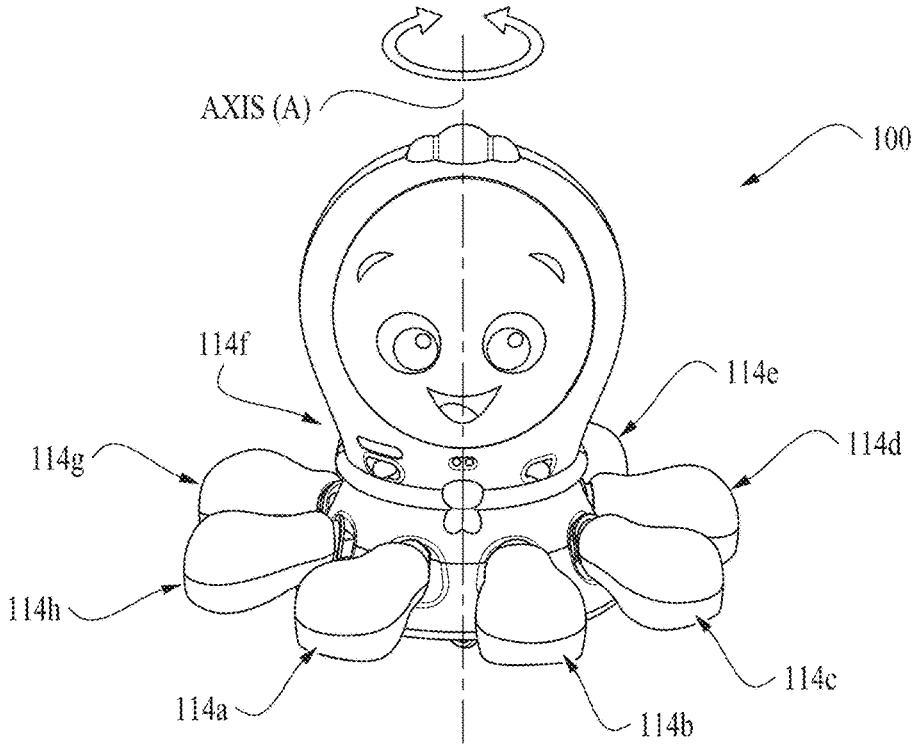
FIGS. 5A-C show example movements of the interactive children's toy of FIG. 1.
Figure 5B:
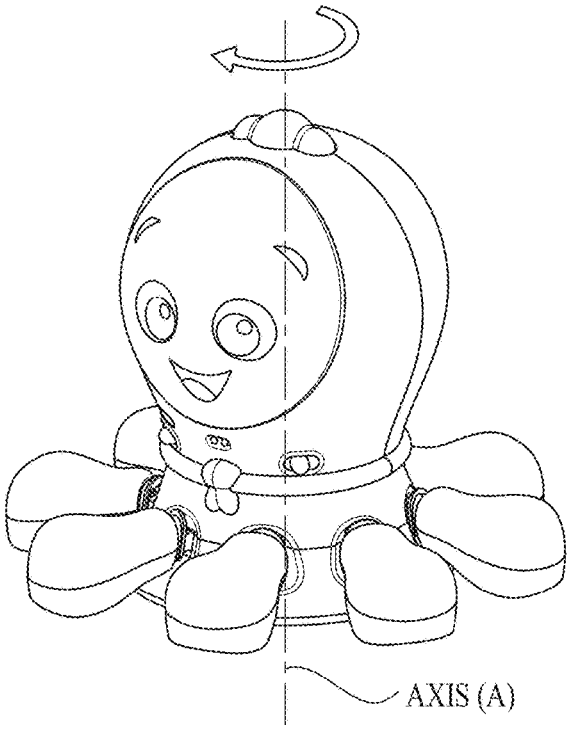
Figure 5C:
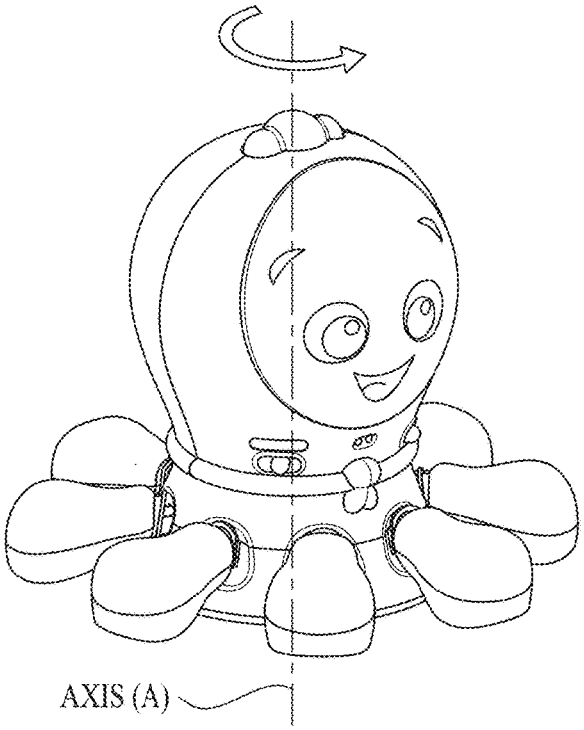

According to example embodiments, the wheels 108*a* and 108*b* are preferably arranged and configured to allow the interactive toy 100 to spin about a vertical axis A, as shown in FIGS. 5A-5C, based on the manner of user interaction with the interactive toy. More specifically, the operation of the drive system may be based on the sequence or order of user interaction with the input areas 114 and the corresponding capacitive touch sensors 106. For example, in the depicted embodiment, the interactive toy 100 includes interactive arms 104*a*-104*h*, with corresponding user input areas 114*a*-114*h*, distributed or arranged around the toy body 102. The input-output control system is configured such that when the user input areas are contacted in a specific sequence or direction, the interactive toy 100 spins in the same direction. For example, referring to FIG. 3, if the user contacts user input area 114*a* followed by user input area 114*h* in the clockwise direction, the drive system spins the interactive toy 100 in the same clockwise direction (see FIG. 5B). On the other hand, if the user contacts user input area 114*a* followed by user input area 114*b* in the counter-clockwise direction, the drive system rotates the interactive toy 100 in the same counter-clockwise direction (see FIG. 5C). In alternative embodiments, the interactive toy 100 may be configured to spin or rotate in the direction opposite of the user input sequence or direction.

In example embodiments, one or more of the speed, acceleration, duration, and amount of rotation or spin may also be dictated by the distance between the user input areas 114, or number of interactive arms between the user input areas, in successive user contacts. For example, a sequence of user inputs including user input areas 114*a* and 114*d* may result in a rotation of faster speed and/or acceleration than a sequence comprising user input areas 114*a* and 114*b*. Conversely, successive user contact with user input areas 114*a* and 114*b* may cause the interactive toy 100 to spin at a slower speed and/or acceleration than successive user contacts made with user input areas 114*a* and 114*d*. In some example embodiments, the rotation of the motors and/or interactive toy 100 depends on the variation in musical note values. Preferably, the interactive toy 100 is configured to rotate or spin enough for the user's hand to make contact with each successive user input area without the user having to move the user's hand. For example, once a user initiates the first contact, the interactive toy will spin so that the next user input area comes into contact with the user's hand without the user moving the user's hand. As long as the user does not move his/her hand, the interactive toy will seamlessly continue to create a fluid play experience as the toy continues to spin.

According to example embodiments, the interactive arms or tentacles 104 are hingedly connected to the toy body 102 so that even if the user's hand is in the way of the interactive arms as the interactive toy spins or rotates, the interactive arms slide around the user's hand and continue spinning. Accordingly, as long as the user's hand remains relatively in the same position, the user's hand continues to make contact with each successive user input area 114 and thus the interactive toy 100 continues to spin in the same rotational direction. The interactive toy comes to a stop only once the user's hand is moved away and no further user contact is made with the user input areas 114.

Figure 6:
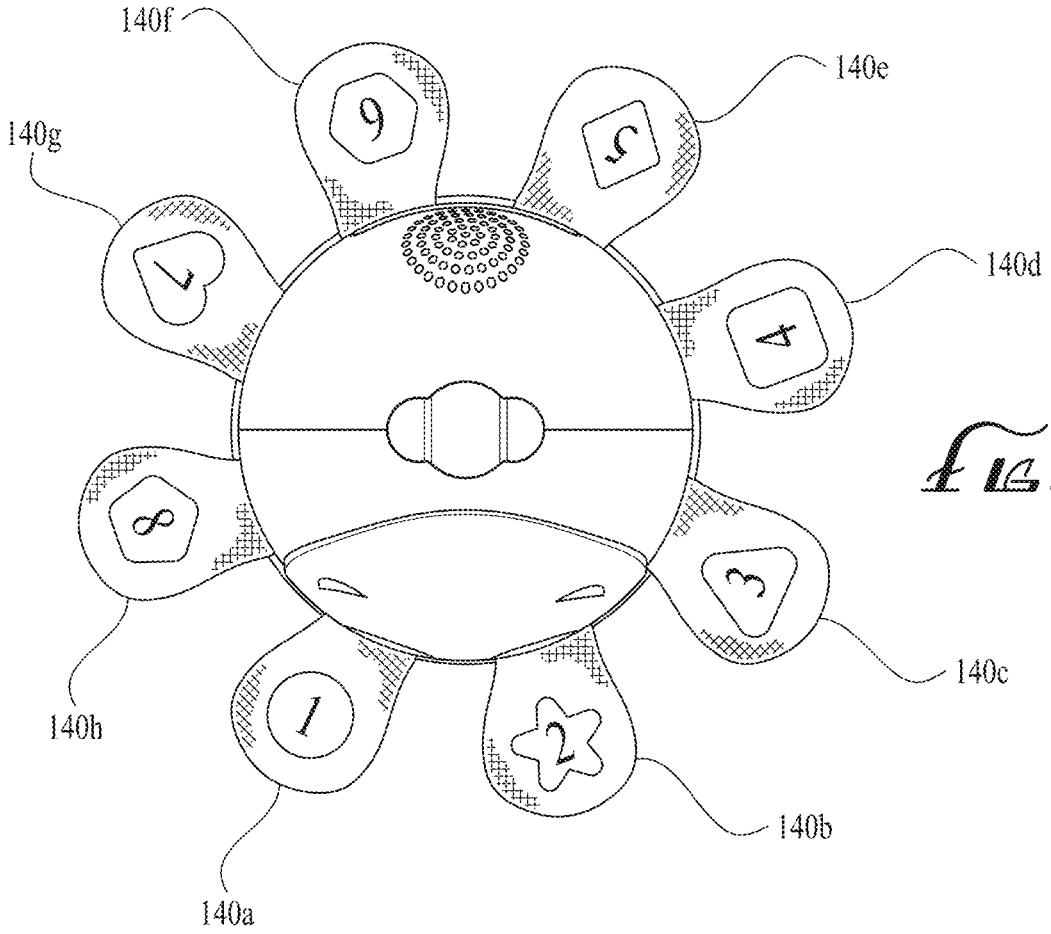
FIG. 6 shows the interactive children's toy of FIG. 1 including decorated sleeves secured over interactive arms of said toy.

As shown in FIG. 6, the children's toy 100 further comprises sleeves or covers 140 for covering the interactive arms or tentacles 104. In example embodiments, the sleeves 140 are made from soft-goods material and are configured to be slipped over or otherwise envelop the interactive arms 104. According to example embodiments, the sleeves 140 comprise one or more learning or educational materials featured thereon. For example, each of the sleeves 140 may comprise a unique color, shape, and/or number. In the depicted embodiment, for example, the sleeves 140*a*-*h* feature the following combination of learning materials or features:

TABLE 1

Combination of features for sleeves 140

| Sleeve | Color | Number | Shape |
|---|---|---|---|
| Sleeve 140a | Orange | 1 | Circle |
| Sleeve 140b | Yellow | 2 | Star |
| Sleeve 140c | Green | 3 | Triangle |
| Sleeve 140d | Lime Green | 4 | Square |
| Sleeve 140e | Purple | 5 | Diamond |
| Sleeve 140f | Teal | 6 | Hexagon |
| Sleeve 140g | Pink | 7 | Heart |
| Sleeve 140h | Red | 8 | Pentagon |

In some example embodiments, the different learning materials may be printed, painted, and/or affixed directly onto the interactive arms 140. It is to be understood that the sleeves 140 may comprise other learning materials/features printed or affixed thereon, such as for example pictures of different animals, different words, alphanumeric characters, and/or symbols, or other suitable material, and/or any combination thereof.

In some example embodiments, the children's toy 100 may also include one or more other output features such as for example, speakers, lights, actuators, or other output devices in electronic communication with the electronic input-output control system for additional visual, audio, and/or haptic effects. For example, in the depicted embodiment, each user input area 114 is mapped or corresponds to a specific note of a musical scale, for example as shown in the table below.

TABLE 2

Example mapping of user input areas.

| User Input Area | C Major Scale | E Major Scale |
|---|---|---|
| 104a | C | E |
| 104b | D | F# |
| 104c | E | G# |
| 104d | F | A |
| 104e | G | B |
| 104f | A | C# |
| 104g | B | D# |
| 104h | C | E |

Accordingly, when contact is made with the user input areas, the interactive toy produces or plays the corresponding notes through speaker 118. In alternative embodiments, the interactive toy 100 may be configured to produce sounds other than musical notes in response to user inputs.

In example embodiments, the children's toy 100 further comprises a lighted display or face 116. In example embodiments, the lighted face 116 comprises a semi-translucent panel with one or more light emitting devices, such as for example light emitting diodes, configured to light the semi-translucent panel. In example embodiments, the light emitting devices are responsive to the user inputs. In yet other example embodiments, the children's toy 100 may further comprise other input features such as for example mechanical switches 124, buttons, actuators, etc. in electronic communication with the electronic input-output control system for selective user control of power on/off, volume control, mode switching, melody activation, and/or other features. Optionally, the interactive toy 100 may further comprise a battery compartment 120 for receiving batteries to power the toy and/or an AC power adaptor and electrical cord connection.

Example components of the interactive toy 100 may include:

SNC86P320SB (16 channel 320 second OTP IC)
4 MB SPI Flash
PCB's and supporting discreet components
2×Single-channel Motor Controllers with reverse (Nyquest NY9M0008B or equivalent)
2×DC/AC Motors and required Gear Boxes
2×SPST Limit Switches (for sensing wheel rotation)
3.3V LDO Regulator
Cap Touch Controller—16 input (Nyquest NY9T016A-006A)
Cap Sensors (foil or similar) for all of the interactive arms or tentacles
1×IR Tx/Rx for detecting obstacles and/or floor boundaries
1×3-position "Double Timing" slide switch: "Off—Low Volume—High Volume"
1×4-position Mode Control slide switch (Tummy—Sit To Play—Chase—Dance)
1 X momentary switch for Try Me Pull tab (for a unique mode for limited testing of the toy's functions while it is still in packaging (i.e., a Try-Me mode). Try Me mode is accessed only when the Try Me Pull Tab remains inserted. During the Try Me mode, the toy is limited to moving side to side in a stationary position while still in its packaging.)
1×Rubber Key for Head Button Activation
3×RGB LEDS for the lighted face—Color Projection
40 mm Speaker
3×AA Battery Contacts
3×AA Battery for Try-Me mode Modes of Play The interactive motorized toy 100 comprises a plurality of modes of play of escalating complexity and interactivity to accommodate and/or challenge the baby or child as he or she grows. In example embodiments, the interactive motorized toy 100 comprises four modes of play: a Tummy-Time Mode, a Sit-to-Play Mode, a Chase Mode, and a "Dance" mode. The different modes of play are selectable by the slide switch 124*b* which comprises a selectable position for each mode of play. Generally, in the Tummy Time mode, the interactive toy 100 is configured to play melodies and sounds with flashing lights in a stationary position. In the Sit-to-Play mode, the interactive toy 100 is configured to play melodies and interactive learning content and rotate side-to-side and spin in circles in a stationary position. In the Chase Mode, the interactive toy 100 is configured to inspire the baby or child to move or chase after the toy as the it moves around a room or play area. In the Chase Mode, the toy 100 utilizes its motorized wheels to rotate and move in multiple directions. In the Dance Mode, the toy 100 is configured to play melodies with learning content inspiring baby or child to move and learn as the toy 100 executes complex motion profiles.

In example embodiments, the interactive toy 100 comprises a switch or actuator 124*a* for powering or activating the toy and controlling the volume of any sound or melody. In the depicted example, the switch 124*a* is a sliding switch selectable between a "power off" setting, a "low volume" setting, and a "high volume" setting. The toy 100 remains off or without power (i.e., the battery is disconnected from all electronics) until the sliding switch is selectively moved from the "power off" setting to either the "low volume" or "high volume" settings. In the "low volume" setting, the level of sound output from the speaker 118 may be limited to a lower decibel, for example about 58 dBA+/−5 dBA playback level, relative to the sound output level in the "high volume" setting having for example about 64 dBA+/−5 dBA playback level. In other example embodiments, the toy 100 may comprise one or more actuators for controlling the power and volume. For example, the toy 100 may comprise an actuator for powering the toy on and off and a separate actuator for controlling the volume. The actuators may comprise switches, buttons, or other similar suitable components or actuators.

In example modes of use, selectively moving the power-volume control switch into either of the low or high volume settings initiates an automatic start-up sequence. The start-up sequence starts with playing a start-up sound or melody. Immediately after the start-up sound is activated, the integrated circuit or controller activates a callback sound or melody according to the mode of play, or play mode, selected at the time the toy is powered on. Alternatively, the mode of play can be changed as desired while the toy 100 is already powered on by selectively moving the slide switch 124*b* to the desired setting or position and pressing the top button 126.

Tummy Time Mode

In the Tummy Time mode, the toy 100 is configured to rotate in a stationary position while playing sounds, tones, and/or melodies. According to example embodiments, the Tummy Time mode can be initiated from the powered off state by selectively moving the sliding switch 124*b* to the Tummy Time setting and then selectively moving the sliding switch 124*a* to either the low- or high-volume setting to power on the toy 100. Alternatively, if the toy 100 is already powered on, the Tummy Time mode can be initiated by selectively moving the sliding switch 124*b* to the Tummy Time setting and then activating or pressing the top button 126.

Once the Tummy Time mode is initiated, the toy 100 will play a sequence of songs and/or melodies dedicated to the Tummy Time mode (i.e., a Tummy Time initiation audio sequence) for a preset amount of time, for example 1 minute. In some example embodiments, the toy 100 may be configured or programmed with a playlist of additional songs, sound effects, and/or melodies which is played in sequence, or randomly, upon further interaction with the toy 100 (for example, upon activation of the top button 126 and/or other user inputs such as for example user inputs 104). For example, pressing the top button 126 during melody or audio playback may trigger the toy 100 (or more specifically, the integrated circuit) to advance to the next song or audio file in the playlist. Alternatively or additionally, initiation of the Tummy Time mode may trigger or activate one or more light sources of the lighted face 116 to display an array or sequence of dynamically changing and fading colors (i.e., a lightshow) creating a fun visual experience for the baby or child in addition to, or in place of, an auditory experience.

In the Tummy Time mode, the interactive arms or tentacles 104 are configured to mimic keys of a piano, and activating the arms (i.e., touching the user input or contact areas 114*a-h* such that contact is detected by the capacitive touch sensors 106*a-h* plays) triggers preset or predetermined visual, auditory, and/or interactive playback or responses. In the depicted example embodiment, a specific note of a piano is assigned to each of the tentacles 104, or capacitive touch sensors 106. For example, tentacle 104*a-h* and capacitive touch sensors 106*a-h* may be configured to play individual notes on a C Major Scale and/or show different colors on the lighted face 116, as follows:

TABLE 3

Visual and Auditory Output per Tentacle

| Tentacle/Cap. Touch Sensor | Sound | Light |
|---|---|---|
| Tentacle 1 (104a/106a) | C | Orange |
| Tentacle 2 (104b/106b) | D | Yellow |
| Tentacle 3 (104c/106c) | E | Green |
| Tentacle 4 (104d/106d) | F | Light Green |
| Tentacle 5 (104e/106e) | G | Purple |
| Tentacle 6 (104f/106f) | A | Blue |
| Tentacle 7 (104g/106g) | B | Pink |
| Tentacle 8 (104h/106h) | C | Red |

It is to be understood that the auditory and/or visual effects may comprise other sounds or sound effects and other colors. For example, the auditory effects may comprise animal sounds or sounds of other instruments. In example embodiments, the toy 100 is further configured to spin or rotate in the direction of the scale played or tentacle activated. For example, if the second input is to the right of the first input, the toy rotates to the right. Similarly, if a subsequent input is to the left of the previous input, the toy rotates to the left.

Sit-and-Play Mode

In the Sit-and-Play mode, the toy 100 is configured to rotate in a stationary position for a 360-degree play pattern around the toy. Pressing any of the interactive arms or tentacles 104 causes the toy 100 to spin 180 degrees clockwise or counterclockwise while playing sounds, tones, and/or melodies. In example embodiments, the toy is configured to alternate spinning in one direction a predetermined number of times (e.g., 3 times) and in another direction another predetermined number of times (e.g., 3 times). According to example embodiments, the Sit-and-Play mode can be initiated from the powered off state by selectively moving the sliding switch 124*b* to the Sit-and-Play setting or position and then selectively moving the sliding switch 124*a* to either the low- or high-volume setting to power on the toy 100. Alternatively, if the toy 100 is already powered on, the Sit-and-Play mode can be initiated by selectively moving the sliding switch 124*b* to the Sit-and-Play setting and then activating or pressing the top button 126.

Once the Sit-and-Play mode is initiated, the toy 100 plays a sequence of songs and/or melodies dedicated to the Sit-and-Play mode (i.e., a Sit-and-Play initiation audio sequence) for a preset amount of time, for example 1 minute. In some example embodiments, the toy 100 may be configured or programmed with a playlist of additional songs, sound effects, and/or melodies which is played in sequence, or randomly, upon further interaction with the toy 100 (for example, upon activation of the top button 126 and/or other user inputs such as for example user inputs 104). In the depicted embodiment, for example, pressing the top button 126 activates sounds and/or melodies from a preprogrammed playlist. Each time the top button 126 is pressed, the toy (or the integrated circuit) cycles through the playlist. Additionally, or alternatively, the toy 100 is configured such that the integrated circuit alternates between a number of learning suites or themes, including for example numbers, shapes, and colors. The toy 100 may be further configured with a sub-feature where only sound effects from the playlist is activated if an input from the top button 126 is detected within for example 0.5 seconds of the last head button activation.

In the Sit-and-Play mode, the interactive arms or tentacles 104 are configured to activate auditory and/or visual effects specific to each tentacle upon activation (i.e., contact detected by the respective capacitive touch sensor 106). Moreover, the auditory and/or visual effects may depend on the learning suite active at the time the tentacles are activated. In example embodiments, for example, activation of each arm 104 may be configured to call out or announce a number when the number learning suite is active; a specific shape when the shape learning suite is active; or a specific color when the color learning suite is active. Additionally, or alternatively, function of the motors and motorized wheels may vary depending on learning suite active at the time the arms are engaged. For example, in example embodiments, the toy 100 alternates between rotating left and right at varying degrees when either the shape or color learning suites are active. If the numbers learning suite is active, the integrate circuit instead operates the motors and motorized wheels in the same manner that they operate in the Tummy Time mode. For example, if a subsequent input is to the left of the previous input, the toy 100 is configured to spin or rotate to the left. On the other hand, if the subsequent input is to the right of the previous input, the toy 100 spins or rotates to the right. In example embodiments, the toy 100 is configured to hold a learning suite until either the toy goes into a standby mode, there has been for example 16 tentacle activations in the same learning suite, or the user manually switches between the different learning suites by activating the top button 126.

Chase Mode

In the Chase mode, the toy 100 is configured to move around a support surface or room upon activation of the top button 126. The objective of the Chase mode is to create a "run-away" feature inspiring the user to chase after to the toy. In example embodiments, the toy 100 moves forward, stops to play a sound to encourage the baby or child to chase it, and then moves again. Preferably, the toy 100 comprises means for detecting obstacles, such as for example an infrared sensor 128, while moving forward. If the toy 100 detects an obstacle, it rotates for example 90 degrees either to the right or the left and continues its forward movement. In some example embodiments, the toy 100 may increase speed upon turning to avoid obstacles. In other example embodiments, the toy 100 may comprise means to detect when the toy 100 is trapped or hung up on an obstacle between its tentacles 104. For example, toy 100 may include a sensor for detecting when the motors are not moving forward. If so, the toy 100 rotates side-to-side. The toy 100 may further comprise one or more limit switches, such as for example SPST limit switches, on each motor gearbox to detect positioning and motor function. If no limit switch is hit or engaged as the toy rotates side-to-side, the toy reverses the direction of the motors.

According to example embodiments, the Chase mode can be initiated from the powered off state by selectively moving the sliding switch 124*b* to the Chase setting and then selectively moving the sliding switch 124*a* to either the low- or high-volume setting to power on the toy 100. Alternatively, if the toy 100 is already powered on, the Chase mode can be initiated by selectively moving the sliding switch 124*b* to the Chase setting and then activating or pressing the top button 126.

The toy 100 is configured so that the difficulty of the chase gradually scales up or down depending on whether the child user is successful in capturing the toy or not. In example embodiments, the difficulty level is increased by one level if the child successfully captures the toy twice in a row. On the other hand, the difficulty level is decreased by one level if the child is unsuccessful in capturing the toy. In this way, the toy 100 caters to the abilities of the child user and optimizes the learning experience for the child. For example, according to example embodiments, the toy 100 starts at a difficulty level 1, the default difficulty level when the toy 100 is powered on. If the child user is successful in capturing the toy twice in a row, the difficulty level is increased by 1 level to difficulty level 2. Similarly, if the child successfully captures the toy two more times in a row, the difficulty level is raised to difficulty level 3. On the other hand, if the child is not successful in capturing the toy 100 at difficulty level 2, the difficulty level is decreased to difficulty level 1. In example embodiments, the difficulty levels are defined by the motor speed and the movement patterns, as follows:

TABLE 4

Difficulty level for Chase Mode

| Difficulty Level | Motor Speed | Movement Pattern |
|---|---|---|
| 1 | Lowest level | Circular movement in the clockwise or counter-clockwise direction |
| 2 | Medium level | Alternate between arching to the right and left (in a circular motion) and moving straight |
| 3 | High level | Turn 180 degrees and continue play pattern in the other direction |

In other example embodiments, there may be less than three or more than three difficulty levels and the specific configurations of motor speed and movement patterns for each difficulty level may be configured as desired.

In the Chase mode, pressing the top button 126 triggers different functions depending on whether the toy is moving or stationary when the top button is activated. For example, if the top button 126 is activated while the toy 100 is moving, the toy is configured to stop moving and play a sound or melody from a stored audio playlist (i.e., a Chase Success playlist) indicating that the toy has been successfully captured while spinning in circles. Conversely, if the top button 126 is activated while the toy 100 is stationary, the toy 100 (or the integrated circuit) activates motor function and sound from another playlist indicating to the child user to begin chasing the toy (i.e., a Call-to-Action playlist).

Similarly, pressing or activating the interactive arms 104 in the Chase mode initiates different functions depending on whether the toy 100 is moving or stationary at the time the interactive arms are activated. For example, if an arm 106 is activated while the toy 100 is moving, the toy is configured to stop moving and play a sound from the Chase Success playlist while spinning around in circles. Conversely, if an interactive arm 106 is activated while the toy 100 is stationary, the toy 100 plays a song or melody from the Call-to-Action playlist and performs a brief motorized pattern while the song or melody is playing. Moreover, if the toy 100 is picked up while in the Chase mode, the toy 100 is configured to play an audio file from a Success Phrase playlist and flash multicolored lights on the lighted face 116 and plays a specific sound to announce that the toy has been picked up.

In example embodiments, the toy 100 plays different melodies based on the success or failure to capture the toy in the Chase mode. For example, if the interactive arms 104 or the head or top button 126 are activated before the melody times out and stops playing, the toy is configured to play a prerecorded phrase from the Chase Success playlist indicating the child has successfully captured the toy. Alternatively, if neither the top button nor any of the arms 104 are activated before the melody times out, the toy 100 plays a sound or melody from yet another playlist (i.e., Chase Fail playlist) indicating that the child was unsuccessful in capturing the toy in the allotted time.

Dance Mode

Figure 7:
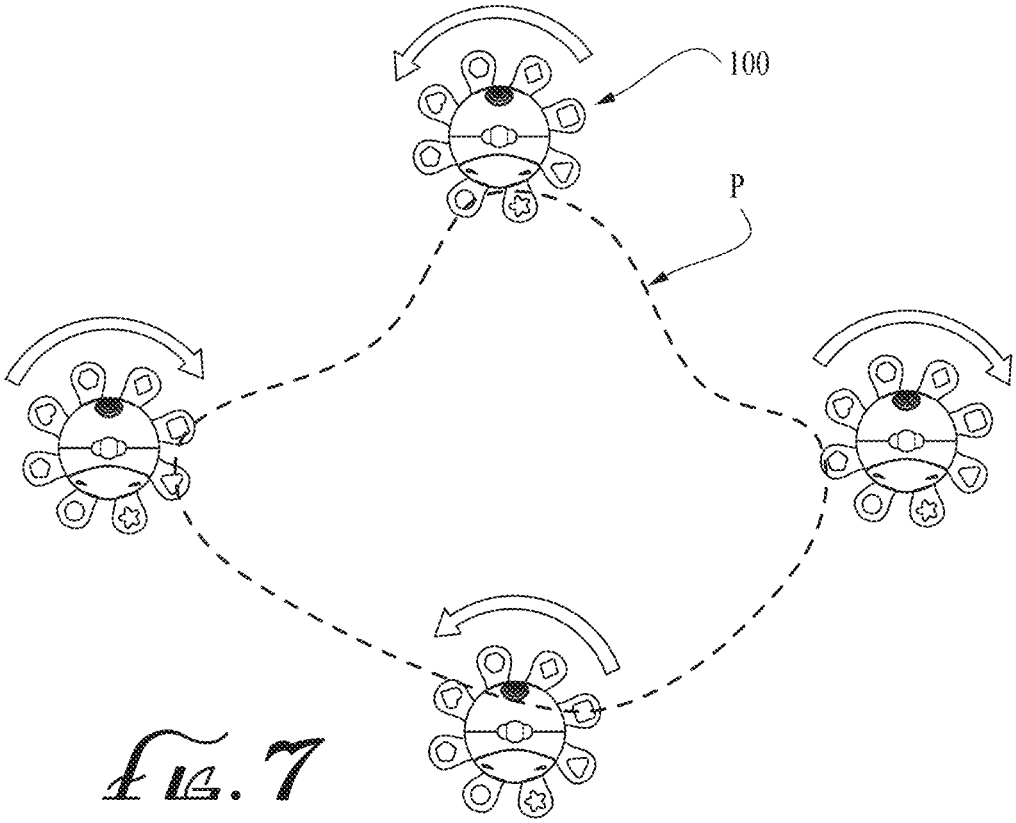
FIG. 7 shows an example movement pattern of the interactive children's toy of FIG. 1 in a Dance mode.

In the Dance mode, the toy 100 is configured to move around in front of the baby or child and inspire them to move as the toy 100 executes complex motion profiles, for example as shown in FIG. 7. According to example embodiments, the Dance mode can be initiated from the powered off state by selectively moving the sliding switch 124*b* to the Dance setting and then selectively moving the sliding switch 124*a* to either the low- or high-volume setting to power on the toy 100. Alternatively, if the toy 100 is already powered on, the Dance mode can be initiated by selectively moving the sliding switch 124*b* to the Dance setting and then activating or pressing the top button 126.

In the Dance mode, pressing the top button 126 activates sung songs from a stored playlist with accompanied motorized dancing or movements in a specific pattern or path P across the floor or support surface, as shown in FIG. 7. Subsequently pressing the top button 126 will further cycle through the stored playlist of the sung songs (i.e., a Dance Mode Music Playlist). Pressing the top button 126 while the motors are already running stops the motors.

Activating any of the arms 104 in the Dance mode triggers the toy 100 to play sounds from other stored playlists (i.e., a Tentacle Dance playlists) with accompanied motor function. As mentioned above, the tentacles 104 are activated through capacitive touch sensors embedded or coupled to each of the arms. In example embodiments, the tentacles 104 are separated into two playlists. For example, arms 104*a-d* may be configured to play sounds from a first playlist whereas arms 104*e-h* are configured to play sounds from a separate second playlist. In other example embodiments, the arms 104 may be separated into more than two playlists.

The toy 100 is configured to keep memory or track of a number of past movement patterns activated by the user and repeat the movement patterns on its own. For example, in example embodiments, the toy 100 keeps track of the last four movement patterns activated. In example embodiments, before the toy 100 plays back the four movement patterns, the toy 100 begins the sequence with playing an initiation sound. In example embodiments, if the toy 100 remains idle for example 15 seconds and under four movement patterns have been activated, it will automatically trigger the activated patterns. For example, if two movement patterns are activated and the toy sits idle for 10 seconds, the toy (or the integrated circuit within the toy) automatically plays the initiation sound and performs the two movement patterns.

Below is an example set of two Tentacle Dance playlists-one playlist for arms 104*a-d* and another for arms 104*e-h*.

TABLE 5

An example Tentacle Dance Playlist for a first set of arms.
Tentacle Dance Playlist A (Tentacles 1-4)

| File Description | Notes |
|---|---|
| Playlist A 1: Move To The Front | Motor Moves Opus Foward |
| Playlist A 2: Wiggle To The Back | Motor moves Opus backward while wiggling side to side |

TABLE 5-continued

| An example Tentacle Dance Playlist for a first set of arms. Tentacle Dance Playlist A (Tentacles 1-4) | |
|---|---|
| File Description | Notes |
| Playlist A 3: Zigzag | Motor Moves Opus in a zig zag pattern |
| Playlist A 4: Spin to the side, spin to the other side | Motor Spins Opus counterclockwise while moving him to the left |

TABLE 6

| An example Tentacle Dance Playlist for a second set of arms. Tentacle Dance Playlist B (Tentacles 5-8) | |
|---|---|
| File Description | Notes |
| Playlist A 1: Move To The Front | Motor Moves Opus Foward |
| Playlist A 2: Wiggle To The Back | Motor moves Opus backward while wiggling side to side |
| Playlist A 3: Zigzag | Motor Moves Opus in a zig zag pattern |
| Playlist A 4: Spin to the side, spin to the other side | Motor Spins Opus counterclockwise while moving him to the left |

During the Dance mode, if an arm 104 is activated while a prior melody is playing, the toy 100 plays an overlay sound specific to the arm that is activated. In example embodiments, if the toy 100 tips over, the toy 100 continues to play music but the motor is stopped for example to prevent user hair entrapment. If the top button 126 is pressed during music playback, the toy 100 stops both the music and the motors, and plays a sound to indicate that the music and movement has stopped.

In some example embodiments, at least one of the wheels comprises a floor detection switch (not shown) to detect when the toy is grounded. If the floor detection switch is active for longer than for example 1 second, the toy immediately ceases motor function. On the other hand, the toy 100 will continue to play any sound or music playing at the time until the sound or music is finished. In example embodiments, the music is activated by pressing the top button 126 and the music playlist depends on the mode. Each of the arms is configured to play a unique sound effect that overlay melodies.

Figure 8:
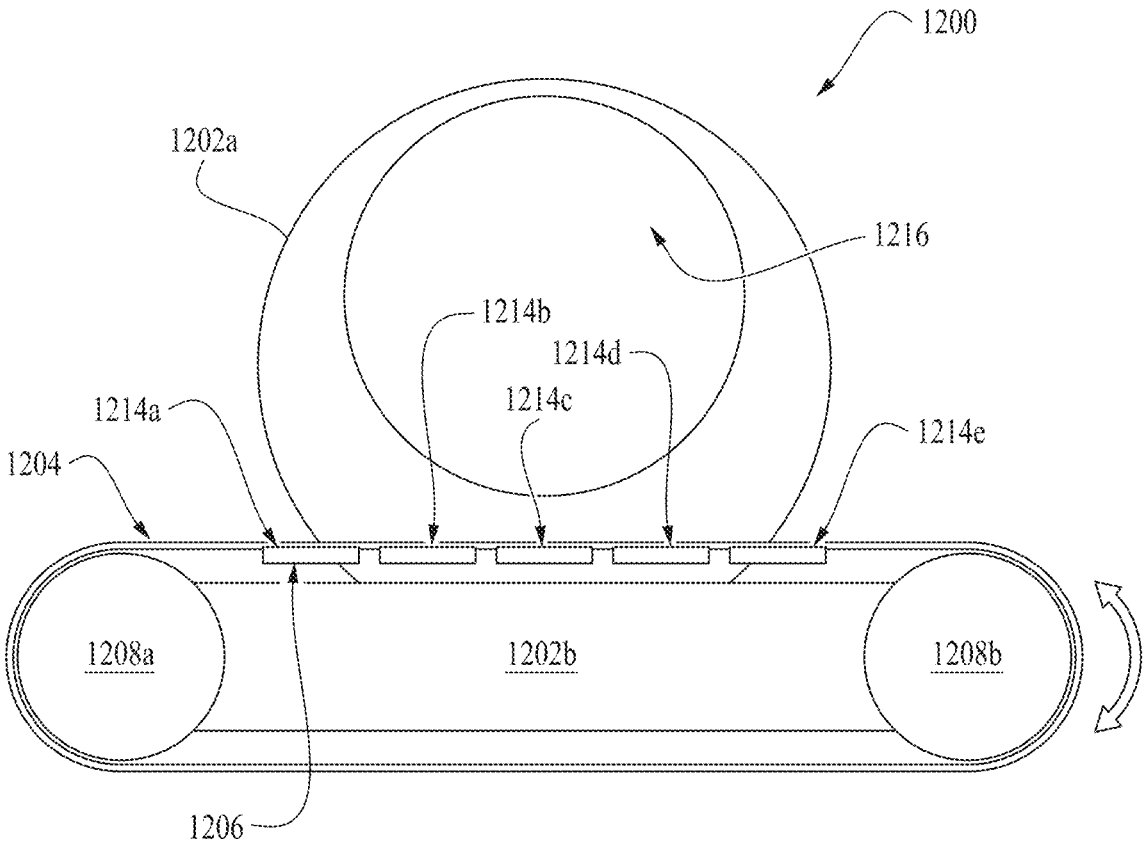
FIG. 8 is a front view of an interactive children's toy according to another example embodiment of the present disclosure.

FIG. 8 shows an interactive children's toy 1200 according to another example embodiment of the present invention. The toy 1200 generally comprises a toy body or housing 1202 having a top portion 1202*a* and a base portion 1202*b*. Wheels 1208*a* and 1208*b* are rotatably connected to the base portion and are driven by one or more motors (not shown). The interactive toy 1200 further includes an interactive track 1204 comprising multiple user input areas (for example, user input areas 214*a*-214*e*) with capacitive touch sensors 1206 affixed or embedded beneath each user input area. The interactive toy 1200 also includes an input-output control system configured to receive user input signals from the capacitive touch sensors and control light, sound, and/or motor activation in response to the user input signals from the capacitive touch sensors 1206, in similar fashion to the above-described embodiments. In example embodiments, the interactive track 1204 is secured to the wheels 1208*a* and 1208*b*. As the wheels rotate in response to user inputs, the interactive track 1204 also rotates and thereby moves the interactive toy 1200 laterally. In similar fashion to other embodiments described above, the operation of the wheels 1208*a* and 1208*b* may be based on the sequence or order of user inputs received.

While the invention has been described with reference to example embodiments, it will be understood by those skilled in the art that a variety of modifications, additions and deletions are within the scope of the invention, as defined by the following claims.

What is claimed is:

1. An interactive children's toy, comprising:

a housing;

at least three user input interfaces for receiving user inputs; and a motor operative in response to the user inputs, wherein the motor is operative to spin the housing about a vertical axis in a first direction or in an opposite, second direction depending on the sequence of user inputs, and wherein one or more of a speed, acceleration, duration, and an amount of spin is determined by a distance between user input interfaces selected in successive user inputs.

2. The interactive children's toy of claim 1, wherein the user input interfaces comprise one or more capacitive touch sensors affixed beneath a respective user input area.

3. The interactive children's toy of claim 1, further comprising light sources operative in response to the user inputs.

4. The interactive children's toy of claim 1, further comprising a processor configured to receive an input signal corresponding to the user inputs.

5. The interactive children's toy of claim 4, wherein the motor is configured to receive an output signal from the processor and to operate in response to the output signal.

6. The interactive children's toy of claim 1, wherein the at least three user input interfaces are arranged circumferentially along the housing.

7. The interactive children's toy of claim 6, wherein each user input interface is equidistant to its adjacent user input interfaces.

8. The interactive children's toy of claim 7, wherein the motor operates at varying intensities based on the distance between successive user inputs, wherein the successive user inputs are input on adjacent or non-adjacent user input interfaces.

9. The interactive children's toy of claim 1, further comprising at least one wheel wherein the at least one wheel is operatively connected to the motor for driving the wheel.

10. The interactive children's toy of claim 1, wherein the plurality of user input interfaces comprises at least three user input interfaces that are distributed radially around a circumference of the housing and, when the user input interfaces are activated in a clockwise direction, the children's toy spins in the clockwise direction and, when the user input interfaces are activated in a counter-clockwise direction, the children's toy spins in the counter-clockwise direction.

11. The interactive children's toy of claim 1, further comprising an audio output device operative in response to the user inputs.

12. The interactive children's toy of claim 11, wherein the user input interfaces are pre-mapped to notes of a musical scale.

13. A motorized rotating toy, comprising:

a toy body;

at least three user input sensors arranged radially around a central base;

one or more wheels attached to the toy body;

a processor configured to receive an input signal corresponding to a user interaction with at least one of the user input sensors; and at least one wheel, at least one light source, and at least one audio speaker configured to receive output signals from the processor and operate corresponding to the output signals, wherein a direction in which the motorized rotating toy spins in place about a vertical axis depends on a sequence in which the user input sensors are activated, and wherein one or more of a speed, acceleration, duration, and an amount of spin is determined by a distance between user input interfaces selected in successive user inputs.

14. The motorized rotating toy of claim 13, wherein the motorized rotating toy comprises more than one mode of play.

15. The motorized rotating toy of claim 14, wherein the motorized rotating toy comprises two or more of a sit-and-play mode, a chase mode, a tummy time mode, and a dance mode, wherein:

in the sit-and-play mode, the motorized rotating toy is configured to emit melodies and/or interactive learning content while rotating side-to-side and spinning in circles;

in the chase mode, the motorized rotating toy is configured to rotate and move around a support surface or floor in multiple directions;

in the tummy time mode, the motorized rotating toy is configured to emit melodies and sounds with flashing lights in a stationary position; and in the dance mode, the entertainment device is configured to emit melodies and/or learning content while executing complex motion profiles.

16. The motorized rotating toy of claim 13, wherein at least one of the user input sensors is a capacitive touch sensor affixed beneath a respective user input area.

17. The motorized rotating toy of claim 13, wherein the user input sensors are mapped to notes of a musical scale.

* * * * *